US006345418B1

(12) United States Patent
Bertrand et al.

(10) Patent No.: US 6,345,418 B1
(45) Date of Patent: Feb. 12, 2002

(54) ROPE HOOK

(75) Inventors: Stephane Bertrand, Valence (FR); Douglas Phillips, Camp Sherman, OR (US)

(73) Assignee: Metolius Mountain Products, Inc., Bend, OR (US)

( * ) Notice: Subject to any disclaimer, the term of this patent is extended or adjusted under 35 U.S.C. 154(b) by 0 days.

(21) Appl. No.: 09/560,697

(22) Filed: Apr. 27, 2000

(51) Int. Cl.[7] ..... B65D 63/00
(52) U.S. Cl. ..... 24/16; 24/199; 24/17 A
(58) Field of Search ..... 24/16 R, 16 PB, 24/17 A, 17 AP, 30.5 R, 182, 197, 183, 199, 200, 298, 302, 369, 907, 370; 248/60, 74.3; 294/146–150, 155–156; 280/814; 224/602, 677

(56) References Cited

U.S. PATENT DOCUMENTS 946,850 A * 1/1910 Tabler ..... 294/149
1,396,270 A * 11/1921 Grierson ..... 224/150
1,490,066 A * 4/1924 Carr ..... 224/577
3,486,672 A * 12/1969 Esopi ..... 24/302 X
5,075,932 A * 12/1991 Hunt et al. ..... 24/16 PB
5,110,023 A * 5/1992 Colin ..... 224/205
5,136,759 A * 8/1992 Armour, II ..... 24/16 R X
5,582,337 A * 12/1996 McPherson et al. ..... 224/660
5,881,436 A * 3/1999 Lyons ..... 24/16 R

* cited by examiner

*Primary Examiner*—Anthony Knight
*Assistant Examiner*—Ruth C. Rodriguez
(74) *Attorney, Agent, or Firm*—ipsolon LLP

(57) ABSTRACT

A rope hook comprises a length of tubular fabric webbing into which a pair of loops has been formed. The first loop serves to attach the hook to an object. A resilient U-shaped member is contained within the tubular webbing to define a U-shaped member for holding a coil of rope. An adjustable fastener spans the opening into the hook for engagement with the second loop.

16 Claims, 2 Drawing Sheets

ROPE HOOK

FIELD OF THE INVENTION

This invention relates to devices used to organize rope, and more specifically, to a rope hook for keeping ropes organized during coiling, uncoiling and storage.

BACKGROUND OF THE INVENTION

Ropes of all types are used in all manners of endeavors, and there are many, many kinds of rope. Anyone who uses ropes is familiar with the problems encountered when coiling and uncoiling the rope. While correct coiling procedures are dictated to some extend by the kind of rope, an example illustrates the point. Correct coiling of a "laid" rope—that is, a rope that has several strands that are twisted about one another along the longitudinal axis of the rope—requires that the rope be looped over onto itself in a manner that accommodates for longitudinal twisting of the rope caused by the formation of numerous loops. This is typically requires that the rope be twisted about ¼ to ½ of a turn along the longitudinal axis of the rope for each loop formed in the coil. If this procedure is followed the rope will tend to not tangle. Braided rope—rope that has a soft, woven outer cover and a braided core—often does not require longitudinal twisting during coiling.

Regardless of the specific coiling procedure that is followed, unless a rope is coiled properly, then it can easily become twisted and knotted when it is uncoiled or paid-out the next time it is used. A knotted, tangled rope can be an inconvenience. Depending upon the use to which the rope is being made, a tangle or a knot can present a dangerous situation.

In rock climbing ropes are often used to provide a safety back up for the climbers. In a typical two-climber team, one climber leads each section or pitch of the climb, setting protection and securing the rope to the protection as the climber progresses up the section. The length of each pitch is dictated by various factors, including to some degree by the length of the rope. The second climber belays the lead climber and pays out rope as the lead climber progresses up the pitch. In belaying the lead climber the second climber must keep the rope somewhat taut. This provides protection for the lead climber if he or she falls, and helps minimize the vertical distance that the falling climber drops.

When the lead climber reaches the top of the pitch he or she top belays for the second, lower climber as that climber ascends the pitch. As the rope is pulled upwardly by the top-belaying climber, it must be coiled to keep it out of the way of the second climber.

Climbing ropes can be quite long, up to 200 feet or more, and the ropes are often quite heavy. In most cases while the second or lower climber is belaying the lead climber, the belaying climber loops the rope over some object such as an arm, leg, knee, ledge or whatever else might happen to be available, and pays it out by pulling out loops of rope one at a time as the lead climber progresses up the pitch. It is common practice for the climber who is managing the rope to lay the rope across his or her knee in what is called a "lap coil." That is, the coil of rope is draped over a knee such that the loops on either end of the coil are positioned on opposite sides of the knee. This helps to keep the rope in place and to keep it organized.

But the belaying climber does not simply hold on to the rope—if the lead climber fell the stress put on the rope as it tightened to stop the fall would be so great that the rope would simply pull out of the belaying climber's hands. Instead, the belaying climber has the rope set through a control device such as a figure 8 or other belay/rappel device that applies frictional braking forces to the rope to stop a fall.

It can be difficult to pay out the rope while holding it over one arm and feeding it through a figure 8 when the lead climber is climbing, and keep to rope organized at the same time. These difficulties are magnified when on technical pitches. It can also be very tiring to hold a rope in this way for any length of time, and it can take a long time to lead through a technical section of a climb. During the time when the lead climber is climbing, the rope that is being held by the belaying climber, if it is not well organized and coiled, can become tangled on equipment or other objects. This can be a dangerous problem for the lead climber, who may not be in close contact with the belaying climber. Adverse weather magnifies all of these concerns. Organized ropes are therefore of extreme importance to climbers.

As another example of the importance of organized ropes, halyards on sailboats are often in the way when a sail is raised. When a sail is fully raised the halyard is at its longest length below the mast. For instance, when a main sail is raised the main halyard extends out of the mast near where the mast is stepped to the deck. To keep the halyard relatively organized it is typically coiled and the coil is lashed to a cleat or winch drum near the bottom of the mast. Even assuming proper coiling, the coiled halyard does not always stay where it is supposed to stay. This is especially true during rough conditions where the seas may be breaking over the deck. If the halyard comes loose then a sailor has to be sent topside to lash the halyard back in place. In calm conditions this is an inconvenience. In heavy weather conditions it is dangerous.

Furthermore, if the halyard is not coiled properly it can become tangled when the sail is dropped. A tangled halyard can be a serious problem if there is a need to drop the sail rapidly. For example, if the main sail needs to be reefed quickly it is important to be able to drop the sail and reef it without tangling the halyard. Reefing in rough conditions is difficult enough without having to untangle a knotted halyard, or a coiled halyard that has been lashed to the mast in such a way as to make unlashing difficult.

It can be appreciated therefore that there is a need for devices that keep properly coiled ropes organized.

SUMMARY OF THE INVENTION

The present invention provides a solution to the problem of disorganized rope coils, and is particularly useful in situations such as climbing and sailing where neatly organized ropes are essential. The invention comprises a hook having a U-shaped section for holding a coil of rope. An adjustable strap is provided to close the U-shaped hook section when the rope is fully coiled and suspended in the U-shaped hook. The U-shaped hook is preferably resilient so that it compresses the rope coil when closed. The hook includes means for attachment to a belt, for use during climbing, or to a fixed object such as a mast.

BRIEF DESCRIPTION OF THE DRAWINGS

The invention will be better understood and its numerous objects and advantages will be apparent by reference to the following detailed description of the invention when taken in conjunction with the following drawings.

DETAILED DESCRIPTION OF PREFERRED EMBODIMENTS

Figure 1:
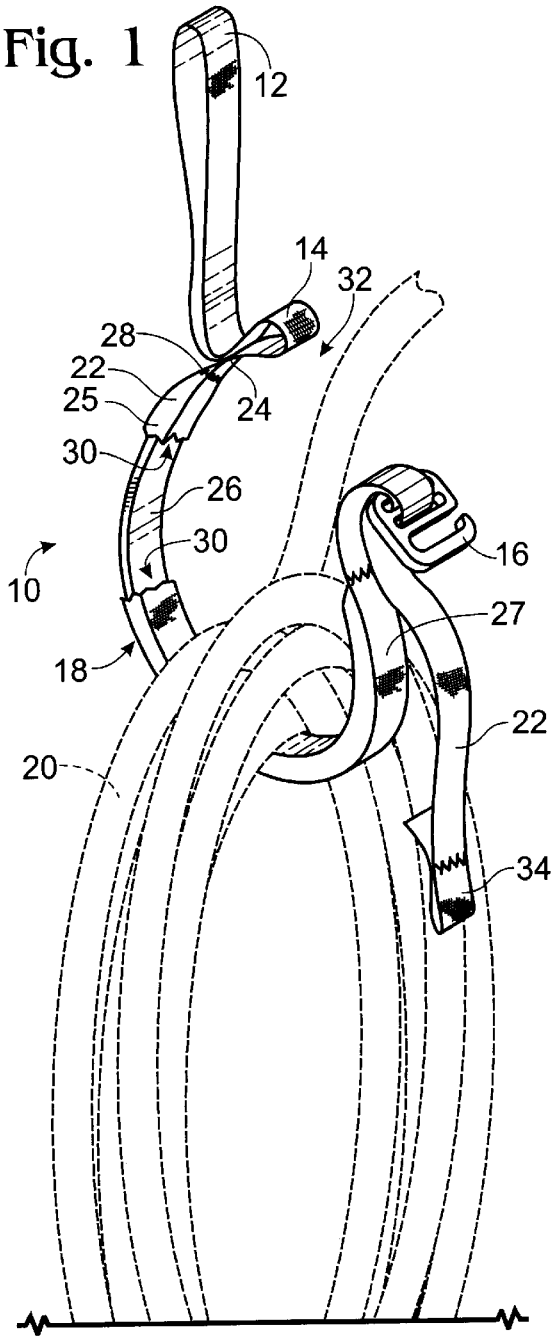
FIG. 1 is a perspective view of a rope hook according to the present invention with part of the webbing cut away and the closure mechanism in the open position.
Figure 2:
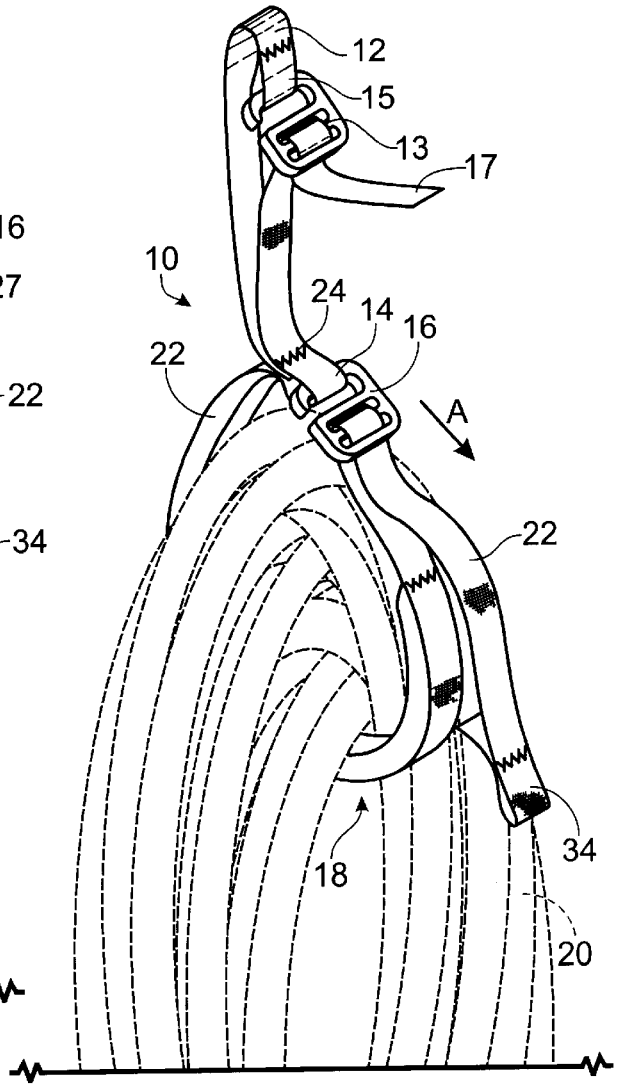
FIG. 2 is a perspective view of a rope hook according to the present invention with the closure mechanism in the closed position to hold a coiled rope in the hook, and illustrating an optional second closure mechanism for an upper loop in the unit.

A preferred embodiment of a rope hook 10 according to the present invention is shown in FIG. 1. As described below, hook 10 may be fabricated from a wide variety of materials, but it is preferably made of a tubular webbing material. Hook 10 includes an upper loop 12 that allows the hook to be, for example, hung on a climber's belt or other equipment, or used to lash the hook to a sailboat's mast or elsewhere on a vessel. As shown in FIG. 2, upper loop 12 may include an optional closure hook 13, which is described below. Adjacent upper loop 12 is a closure loop 14 that interconnects with a standard adjustable bra-type hook 16 to close the opening into a stiff and preferably resilient U-shaped rope hanger 18 that depends downwardly from closure loop 14 to define a hook for holding a coiled rope 20.

As noted, hook 10 may be manufactured from a wide variety of materials. However, it is preferably fabricated from a single continuous piece of tubular seamless nylon webbing 22 that includes an internal longitudinal passageway in which U-shaped rope hanger 18 is held. The hook may be fabricated from a single length of webbing or from multiple pieces connected together, for instance by stitching. With reference to FIG. 1, upper loop 12 and closure loop 14 are formed by folding webbing 22 over onto itself to form the loops and then closing the loops by, for instance, stitching the webbing at stitch point 24.

The U-shaped rope hanger 18 is formed by inserting a U-shaped member 26 into the internal passageway in webbing 22 as illustrated. Member 26 may be formed of a variety of materials that preferably provide some amount of resiliency between the opposed upwardly extending arms of the U. Resilient arms allow the upwardly extending arms of the member to be urged toward one another to tighten a coil of rope 20 held in the rope hanger. As described below, this force is applied by a hook and strap that extends across the arms of the U-shaped rope hanger. When the closing force is released by releasing the hook, the resilient arms will resume their original upright positions. Member 26 may be formed of many kinds of plastics, such as PVC compounds, or may be metal such as a resilient stainless steel or spring steel. Member 26 has opposed upwardly extending arms that are interconnected with a smoothly curved section. For reference purposes herein, the first upwardly extending arm, which is either directly or indirectly connected to upper loop 12 and closure loop 14 is referred to as first arm 25. The opposite arm, which is either directly or indirectly connected to hook 16, is referred to as second arm 27.

Stitching 28 is provided across webbing 22 adjacent the opposite ends of member 26 to define a closed internal pocket 30 in which member 26 rests. A bra-type clasp hook, otherwise known as a two bar slide hook 16 is threaded onto a length of webbing 22 that extends beyond the distal end of second arm 27, and a loop 34 may be formed in the outer end of webbing 22 to function as a keeper to prevent hook 16 from sliding off the end of the webbing, and to provide a grasp point for pulling on the webbing. The material extending beyond the end of member 26 defines an optional closure mechanism for closing the opening 32 into the U-shaped rope hanger 18.

Many variations are available for making hook 10. To name just a few, the hook 10 may be made from nylon webbing that is not tubular. In this case U-shaped member 26, which could be of any suitable material as described above, would be connected directly to the non-tubular webbing at both ends of the U-shaped member in a suitable manner, such as stitching or riveting. U-shaped member 26 need not have a smoothly curved bottom radius as shown in the drawings, but could instead be formed in a rectangular shape having one side open. Upper loop 12 may take the form of any structure that allows the hook to be attached to an object such as a climber's belt or a mast. Upper loop 12 may thus be replaced with a hook, clip or the like. Similarly, closure loop 14 may be configured for cooperative selective engagement with any mechanism for closing opening 32. Thus, the mechanism for closing opening 32 may be varied widely without departing from the invention, and could be any appropriate clip or other releasable fastening device for closing the opening.

It will be appreciated that upper loop 12 may be attached directly to the first arm 25 of the U-shaped member, such that the U-shaped member depends from it, or indirectly to it, as exemplified in the case of the preferred embodiment which uses tubular fabric webbing. The same applies to the closure loop and to the mechanism that is used for spanning the opening into the U-shaped rope hanger to close the opening and contain a coil of rope therein. As another example, the closure mechanism may be either directly or indirectly connected to the second arm 27 of the U-shaped member. In the example shown in the figures, hook 16 is indirectly connected to second arm 27 by virtue of the fabric webbing.

Prior to its being used, rope hook 10 is usually itself connected to an object such as a climber's belt of other equipment, or to a mast. The object that the hook is attached to depends of course upon the particular use to which the hook is being made. For example, when climbers are hiking into a climb a climber's belt could be passed through upper loop 12 to suspend hook 10 from the belt. As another example, if the hook is being used to keep a rope organized during hiking, the hook could be attached to a backpack through upper loop 12. Just as well, the hook could be attached to a mast or some other part of a boat with upper loop 12. And during an actual climb, the rope hook may be attached to a belay anchor using a carabiner or snap link.

Referring to FIG. 2 it is often desirable to include a closure hook 13 in upper loop 12 to facilitate attachment of the upper loop to an object such as a mast cleat, a railing or a closed loop on a backpack. Hook 13 is shown as identical to two bar slide hook 16, but could be any kind of closure mechanism that allows the loop to be selectively opened and closed, a preferably includes an adjustment feature as shown. When a closure hook 13 is included, the fabric in loop 12 is cut and a loop 15 is formed for receiving hook 13 as shown. The tail end 17 formed by cutting loop 12 is threaded through hook 13 and provides for adjustment of loop 12 to, for instance, cinch it to an object such as a cleat or stanchion.

With two bar slide hook 16 detached from closure loop 14 as shown in FIG. 1, rope 20 is coiled such that the loops are passed through opening 32 and are hung on the U-shaped member. Alternately, the rope could be coiled separately from hook 10, with the completed coil inserted through opening 32. As noted above, proper coiling requires that the rope be longitudinally twisted with each loop that is formed. Proper coiling helps to make sure that the rope that is coiled onto hook 10 is maintained in an organized and that it is easily uncoiled.

Figure 3:
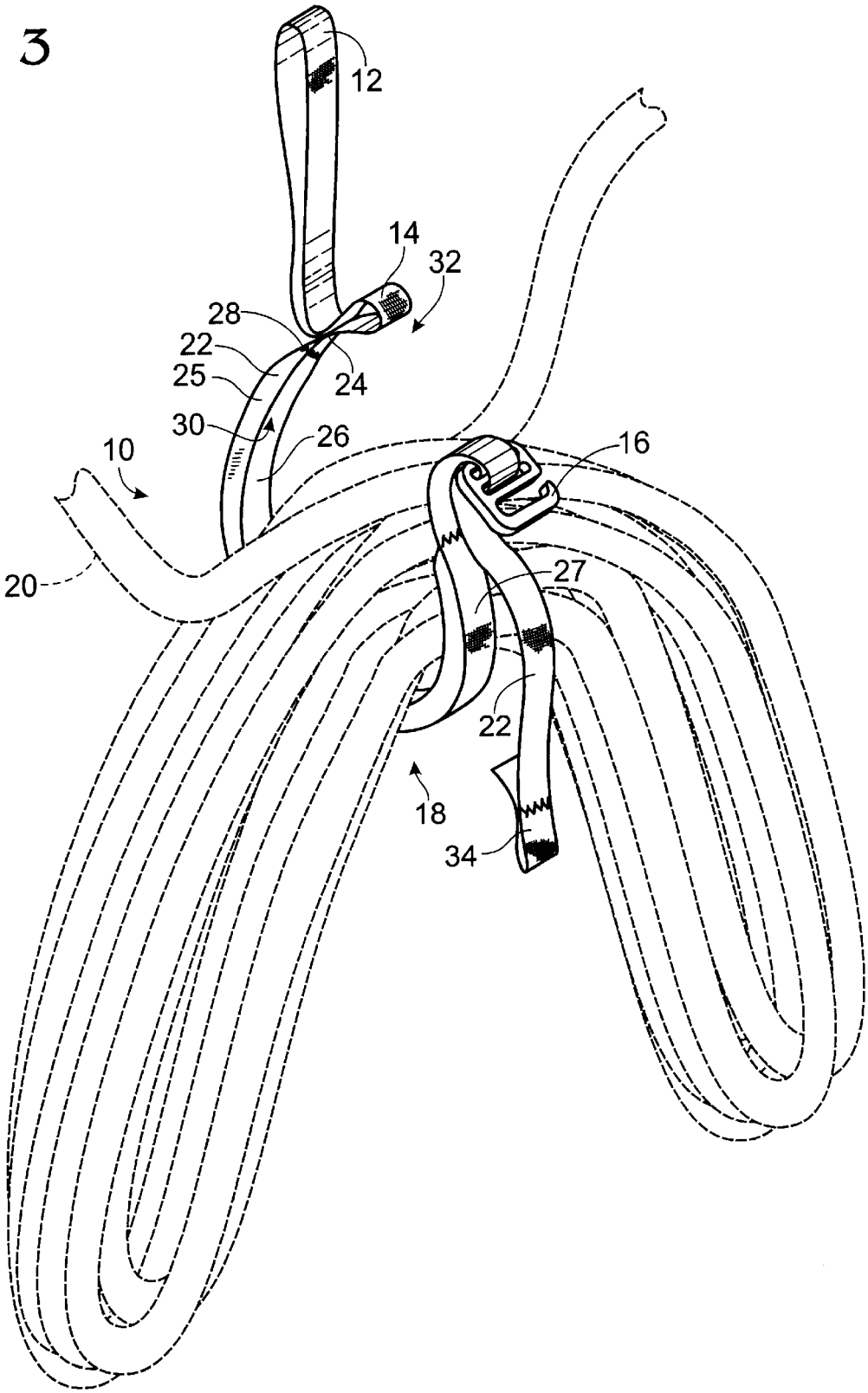
FIG. 3 is a perspective view of a rope hook similar to the unit shown in FIG. 1 with the rope laid into the rope hook in a lap coil.

In the case where the rope hook is being used to manage ropes during a climb, the rope will often be coiled into a lap coil; each separate lap coil is laid across the rope hook in a back and forth manner as the lower climber ascends toward the upper climber. Continuing with this example, if the two climbers are not swapping leads—that is, the same leader will continue up the next pitch—the coils on either side of the rope hook may be grasped and the entire rope coil may be rotated within the hook so that the correct end (i.e., the end that is nearest the lead climber) is located on the top of the lap coil. A lap coiled rope laid into the rope hook is shown in FIG. 3.

The opening into the hook may be closed when the climb is completed or when it is desirable to secure the rope in the hook. With the rope completely and properly coiled and laid into the, two bar slide hook 16 is connected to closure loop 14 as shown in FIG. 2, and webbing 22 is pulled through the slide hook to cinch it tight. This is done by pulling loop 34 in the direction A in FIG. 2, resulting in the upright resilient arms of member 26 being urged toward one another, and against the coil of rope held within the member. Deformation of the upright resilient arms from their resting position results in compression of the coil of rope within the hook. With the closure member spanning opening 32 to close it in this manner the free ends of the rope are tied off in known manners and following proper coiling procedures for the particular type of rope that is being used. When closed in this manner, rope hook 10 will keep the coiled rope in an organized arrangement.

The rope can easily be uncoiled by disconnecting two bar slide hook 16 from its engagement with closure loop 14. The tension on the fabric webbing may need to be relieved prior to disengaging hook 16 from loop 14, and this is accomplished by sliding the webbing through the hook in the direction opposite arrow A. The entire coil of rope may then be removed all at once, or the rope may be uncoiled gradually as needed in a particular circumstance.

While the present invention has been described in terms of a preferred embodiment, it will be appreciated by one of ordinary skill that the spirit and scope of the invention is not limited to those embodiments, but extend to the various modifications and equivalents as defined in the following claims.

We claim:

1. A rope hook, comprising:

substantially U-shaped rope holding member having a first upright arm and a second upright arm defining an opening therebetween, means associated with said first arm for connecting said member to an object;

closure means for closing said opening into said U-shaped rope holding member to secure a coiled rope in said U-shaped rope holding member; and a length of tubular webbing material having a longitudinal internal passageway therethrough, wherein said means for connecting said member to an object comprises a section of said tubular webbing material folded over itself to define a first closed loop, and said U-shaped rope holding member is contained within said internal passageway.

2. The rope hook according to claim 1 wherein said closure means is adjustable and comprises a hook connected to a strap extending from said second upright arm and loop means on said first upright arm configured for engaging said hook.

3. The rope hook according to claim 1 further comprising a second closed loop formed in said tubular webbing adjacent said first closed loop, and wherein adjustable closure means comprises a hook connected to a length of said tubular webbing extending from said second upright arm, wherein said hook is configured for engaging said second closed loop.

4. The rope hook according to claim 1 wherein said means for connecting said member to an object comprises a fabric loop.

5. The rope hook according to claim 4 wherein said first upright arm of said U-shaped rope holding member is connected to said fabric loop.

6. The rope hook according to claim 4 in which said fabric loop includes closure means for selectively opening and closing said loop.

7. A rope hook, comprising:

rope coil receiving member having interconnected first upright member and second upright member defining an opening therebetween;

a first loop formed of fabric connected to said first upright member;

a hook connected to said second upright member for spanning said opening to close said opening; and a second loop formed of fabric connected to said first upright member and configured for engaging said hook.

8. The rope hook according to claim 7 wherein said hook comprises a hook including continuous adjustment means, said hook adjustably held on a length of fabric extending from said second upright member.

9. The rope hook according to claim 7 in which the rope coil receiving member comprises a resilient substantially U-shaped member.

10. The rope hook according to claim 9 wherein the first and second upright members are resiliently deformable between a first position and a second position.

11. A rope hook, comprising:

tubular fabric defining an internal passageway in said fabric;

resilient U-shaped member in said internal passageway defining a U-shaped rope coil holding member, said U-shaped member having opposed first and second upright arms defining an opening into said rope coil holding member between the respective distal ends of said first and second upright arms;

first loop formed in said fabric adjacent the distal end of said first upright arm;

second loop formed in said fabric adjacent said first loop;

closure member connected to a length of said fabric extending from said distal end of said second upright arm, said closure member configured for engagement with said second loop to close said opening into said rope coil holding member.

12. The rope hook according to claim 11 wherein said closure member comprises a hook configured for engaging said second loop and for slideable adjustment along said length of fabric.

13. The rope hook according to claim 11 wherein said first loop is configured for securing said rope hook to an object.

14. A rope hook, comprising:

tubular fabric defining an internal passageway;

a resilient member in said internal passageway defining a curved rope coil holding member, said resilient member having opposed first and second ends defining an opening therebetween into said curved rope coil holding member;

a first loop adjacent said first end of said resilient member configured for connecting said resilient member to an object;

wherein opening into said rope coil holding member is selectively openable and closable to allow a coil of rope to be inserted into and removed from said curved rope coil holding member.

15. The rope hook according to claim 14 wherein said resilient rope coil holding member is deformable.

16. The rope hook according to claim 14 wherein said curved rope coil holding member defines a smoothly curved member for holding a coil of rope.

* * * * *